US006749077B1

(12) United States Patent
McAlpine et al.

(10) Patent No.: US 6,749,077 B1
(45) Date of Patent: Jun. 15, 2004

(54) COLLAPSIBLE CRATE AND ASSOCIATED CONNECTING MEANS

(76) Inventors: Gilroy Clements McAlpine, Factory No. 2, 507 Pretoria Road, Fairleads, Benoni (ZA), 1501; Alexander John Bronkhorst, Factory No. 2, 507 Pretoria Road, Fairleads, Benoni (ZA), 1501

( * ) Notice: Subject to any disclaimer, the term of this patent is extended or adjusted under 35 U.S.C. 154(b) by 0 days.

(21) Appl. No.: 09/890,994

(22) PCT Filed: Feb. 9, 2000

(86) PCT No.: PCT/ZA00/00020

§ 371 (c)(1),
(2), (4) Date: Nov. 7, 2001

(87) PCT Pub. No.: WO00/47482

PCT Pub. Date: Aug. 17, 2000

(30) Foreign Application Priority Data

| | | |
|---|---|---|
| Feb. 9, 1999 | (ZA) | 99/1010 |
| Jun. 22, 1999 | (ZA) | 99/4103 |
| Dec. 9, 1999 | (ZA) | 99/7570 |

(51) Int. Cl.[7] ..... B65D 6/22
(52) U.S. Cl. ..... 220/4.29; 220/4.33
(58) Field of Search ..... 220/4.33, 4.29

(56) References Cited

U.S. PATENT DOCUMENTS

| | | | | |
|---|---|---|---|---|
| 3,857,540 A | * | 12/1974 | Ecker | 249/48 |
| 4,624,381 A | | 11/1986 | Friedrich | 220/7 |
| 5,377,857 A | | 1/1995 | Taravella et al. | 220/4.33 |
| 5,497,895 A | * | 3/1996 | Rudbach | 220/4.33 |
| 5,638,973 A | * | 6/1997 | Dewey et al. | 220/4.33 |
| 5,722,551 A | * | 3/1998 | Cocciemiglio, Jr. | 220/4.33 |
| 5,971,187 A | * | 10/1999 | Clee et al. | 220/4.29 |
| 5,996,828 A | * | 12/1999 | Cheyn | 220/4.33 |
| 6,241,148 B1 | * | 6/2001 | Schwimmer | 229/122.21 |

FOREIGN PATENT DOCUMENTS

| | | |
|---|---|---|
| DE | 3347367 | 7/1985 |
| DE | 29703221 | 7/1998 |
| EP | 0573729 | 12/1993 |
| FR | 2018317 | 5/1970 |
| FR | 2194611 | 3/1974 |

* cited by examiner

*Primary Examiner*—Joseph Man-Fu Moy
(74) *Attorney, Agent, or Firm*—Ostrolenk, Faber, Gerb & Soffen, LLP

(57) ABSTRACT

According to the invention there is provided a collapsible container (10) comprising a base panel (11); opposed side wall panels (13) and opposed end wall panels (12), the side wall panels (13) and end wall panels (12) being movable to an upright position relative to the base panel (11) so as to define corner zones at their junctions; and corner posts (25) releasably connecting adjacent side wall panels (13) and end wall panels (12) where they adjoin one another in the upright position, each corner post (25) having connecting formations (26, 28) for receiving and connecting the side wall panels (13) and end wall panels (12) thereto. The invention also extends to corner post (25) suitable for a container (10) formed of sheet material so as to define corner zones at a junction between side wall panels (13) and end wall panels (12) of the container (10); to a blank of sheet material for a collapsible container (10); and to a method of erecting a collapsible container (10).

14 Claims, 12 Drawing Sheets

COLLAPSIBLE CRATE AND ASSOCIATED CONNECTING MEANS

TECHNICAL FIELD

This invention relates to a collapsible container and to connecting means for use in association therewith.

BACKGROUND ART

Collapsible containers of various designs are available on the market. They are particularly useful for the conveyance of produce such as fruit and vegetables, but are not confined to the conveyance of produce. Collapsible containers generally suffer from a number of disadvantages. One disadvantage is that they tend to be relatively complicated in their construction, which makes them relatively expensive to manufacture. In addition, collapsible containers can be difficult and time-consuming to erect, which often leads to user resistance to these types of containers. A further disadvantage is that, once erected, many of these types of containers lack rigidity so that they are relatively easily deformed through handling and stacking, often resulting therein that conveyed goods are damaged.

OBJECT OF THE INVENTION

It is accordingly an object of the present invention to provide a novel collapsible container, which seeks to overcome the abovementioned disadvantages, or which at least will provide a useful alternative to prior art containers. A further object of the invention is to provide a container, which can be of a relatively thin wall material yet capable of being stacked.

DISCLOSURE OF THE INVENTION

According to the invention there is provided a collapsible container comprising a base panel;

opposed side wall panels and opposed end wall panels, the side wall panels and end wall panels being movable to an upright position relative to the base panel so as to define corner zones at their junctions; and corner posts releasably connecting adjacent side wall panels and end wall panels where they adjoin one another in the upright position, each corner post having connecting formations for receiving and connecting the side wall panels and end wall panels thereto.

According to the invention there is also provided a corner post suitable for a container formed of sheet material so as to define corner zones at a junction between side wall panels and end wall panels of the container, the corner post comprising connecting formations for receiving and connecting the side wall panels and end wall panels thereto.

The connecting formations of the corner post may be adapted to interconnect with the side wall panels in the form of a snap fit.

Each corner post may comprise at least one set of flanges, the set of flanges comprising a pair of parallel flanges between which a side wall panel is received.

According to one form of the invention,.each corner post may comprise a tubular member having two sets of flanges directed at substantially right angles to one another. Each pair of flanges may comprise an outer flange and an inner flange Each outer flange may have integral lugs which engage in corresponding apertures formed in the side wall panels. The lugs on the outer flange may be located opposite corresponding apertures provided on the inner flange.

Alternatively, each outer flange may include at least one engaging formation adapted releasably to engage a slotted aperture formed in the inner flange. The engaging formation may protrude through a corresponding aperture formed in the side wall panels before locating in the slotted aperture of the inner flange.

According to an alternative form of the invention the corner post may comprise an outer post section which is adapted to mate with an outer surface of the corner zone;

an inner post section which is adapted to mate with an inner surface of the corner zone; and connecting means adapted to couple together the outer post section and the inner post section, so as to sandwich sheet material at the corner zone between these sections.

The connecting means may comprise engagement formations on the outer post section or on the inner post section, which mate with corresponding engagement formations on the inner post section or outer post section respectively.

The engagement formations may comprise tongue formations on the outer post section or inner post section, which are adapted to pass through apertures in the sheet material and which are adapted to engage the inner post section or outer post section as the case may be. Particularly, the tongue formations may extend from the inner post section and may be adapted to engage in apertures in the outer post section. More particularly, for engagement purposes the tongue formations may define lateral hook or barb elements that engage the outer post section.

The corner post also may include inter engaging tongue and groove formation at the upper ends of the post sections, with the inner post section preferably defining a downwardly directed groove formation and the outer post section an upwardly directed tongue formation.

Each corner post may include stacking means adapted releasably to engage complementarily dimensioned stacking means on a corresponding corner post when two containers according to the invention are stacked upon one another. Particularly, the stacking means may be a downwardly depending foot formation defined by the outer post section, with the inner post section being adapted to engage such foot formation, for example in spigot and socket fashion.

In one form of the invention, the stacking means may be an integral spigot located at one end of a corner post and adapted to be received in a socket formed in an opposite end of a corresponding corner post when two containers are stacked upon one another. In another form of the invention, the spigot may be in the form of an expanding barb adapted to pass through the base of the container and to lock within the socket.

The side wall panels and end wall panels may be connected to the base panel by any suitable hinge means such as ringlets, crease lines, perforations, film hinges or the like.

The container further may include at least two connectable roof panels adapted releasably to engage one another. Particularly, one roof panel may include a number of slotted apertures for receiving complimentarily dimensioned lip formations extending from the other roof panel.

Also included within the scope of the invention is a blank of sheet material for a collapsible container, the blank comprising a base panel;

opposed side wall panels hingedly connected to the base panel; and opposed end wall panels hingedly connected to the base panel, the side wall panels and end wall panels being hingeable to an upstanding position relative to the base panel so as to define corner zones at their junctions, the arrangement being one wherein the side wall panels and end wall panels are provided with apertures at the corner zones, the apertures being adapted to receive fastening means for corner posts therethrough.

The invention is further directed to a collapsible container including the corner post of the invention and the blank disclosed above.

Further included within the scope of the invention is a method of erecting a collapsible container comprising the steps of providing the container blank and the corner posts in accordance with the invention; folding, the side wall panels and end wall panels of the blank into an upstanding position relative to the base so that their ends meet to define corner zones; and releasably connecting corner posts to the side wall panels and end wall panels so as to clamp the sheet material at each corner zone there between.

BRIEF DESCRIPTION OF DRAWINGS

Without limiting the scope thereof, the invention will now be described by way of examples only with reference to the accompanying drawings in which.

SPECIFIC EMBODIMENT OF THE INVENTION

Figure 1:
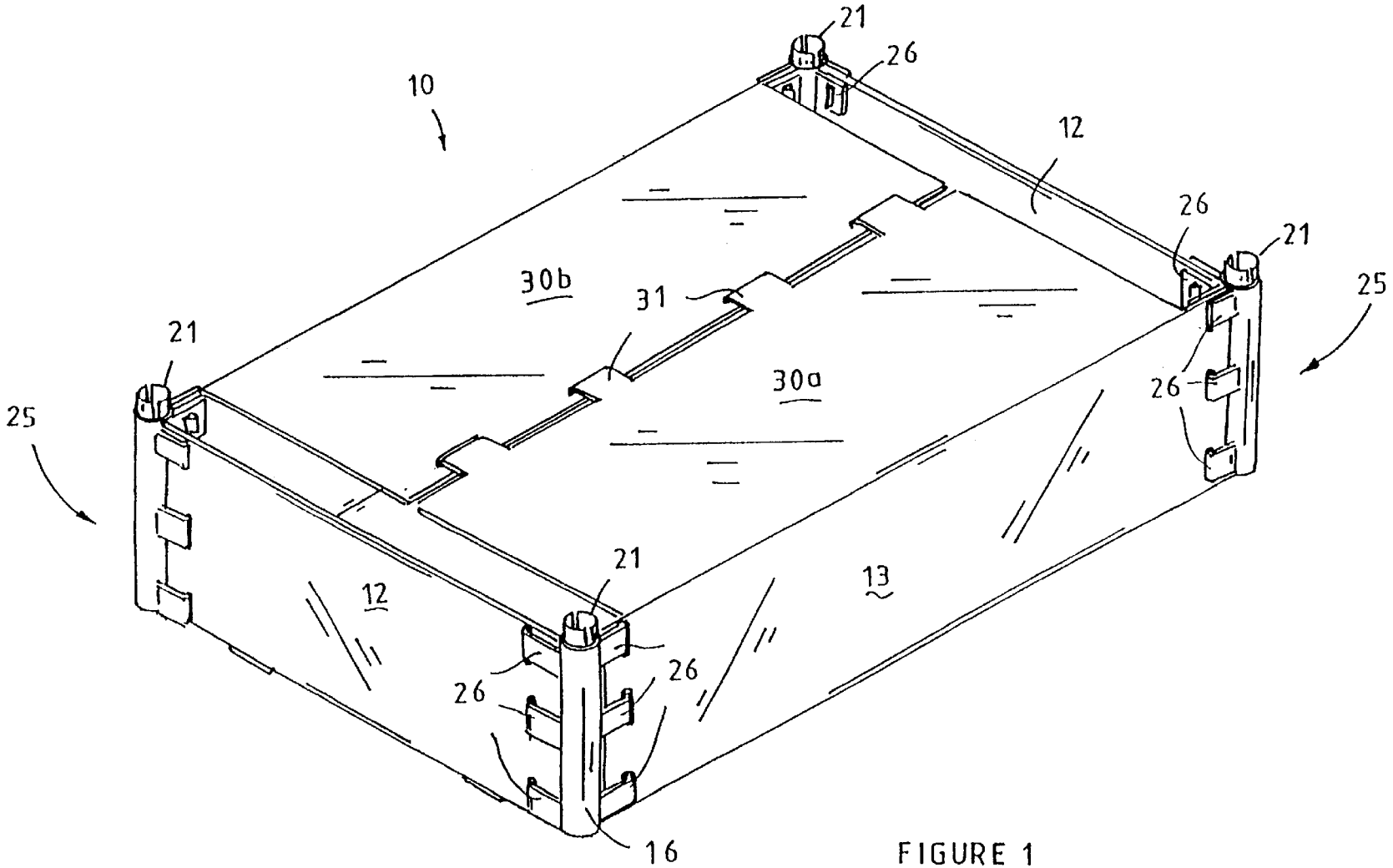
FIG. 1 is a perspective view of a container according to one embodiment of the invention with the container in an erected condition.
Figure 2:
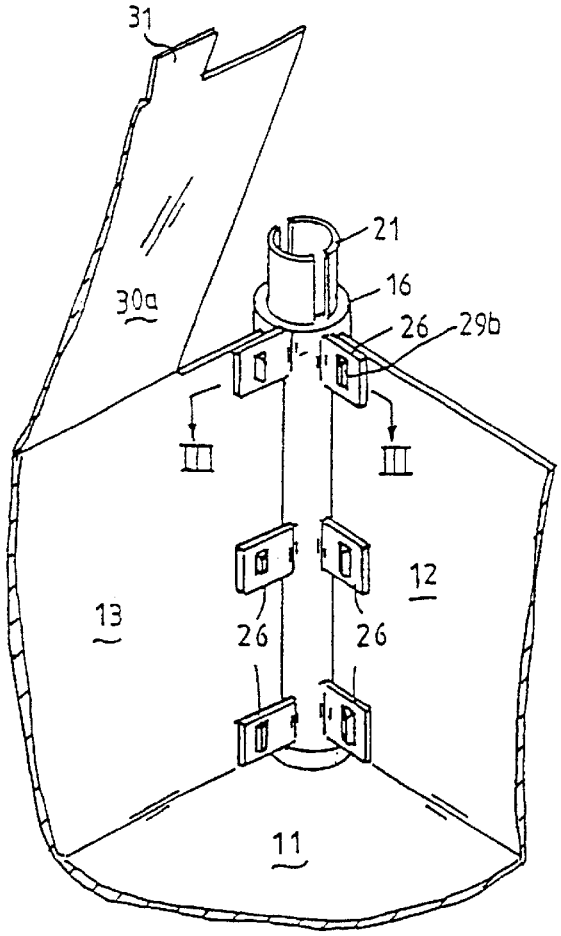
FIGS. 2 and 3 illustrate parts of the container of FIG. 1.
Figure 3:
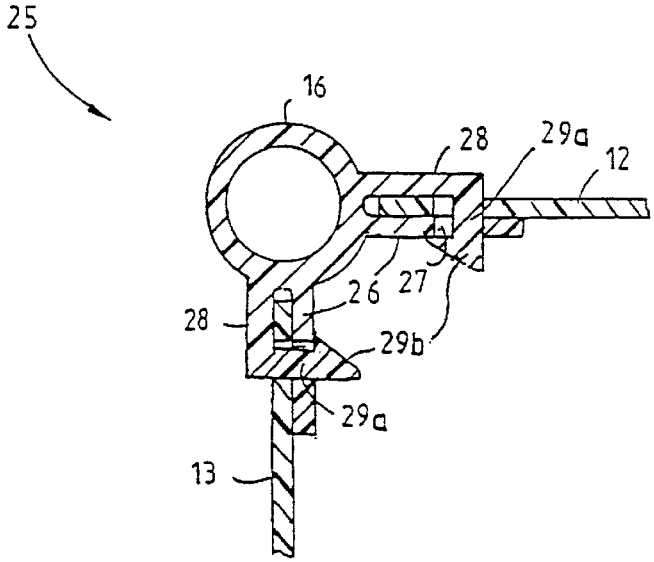
Figure 4:
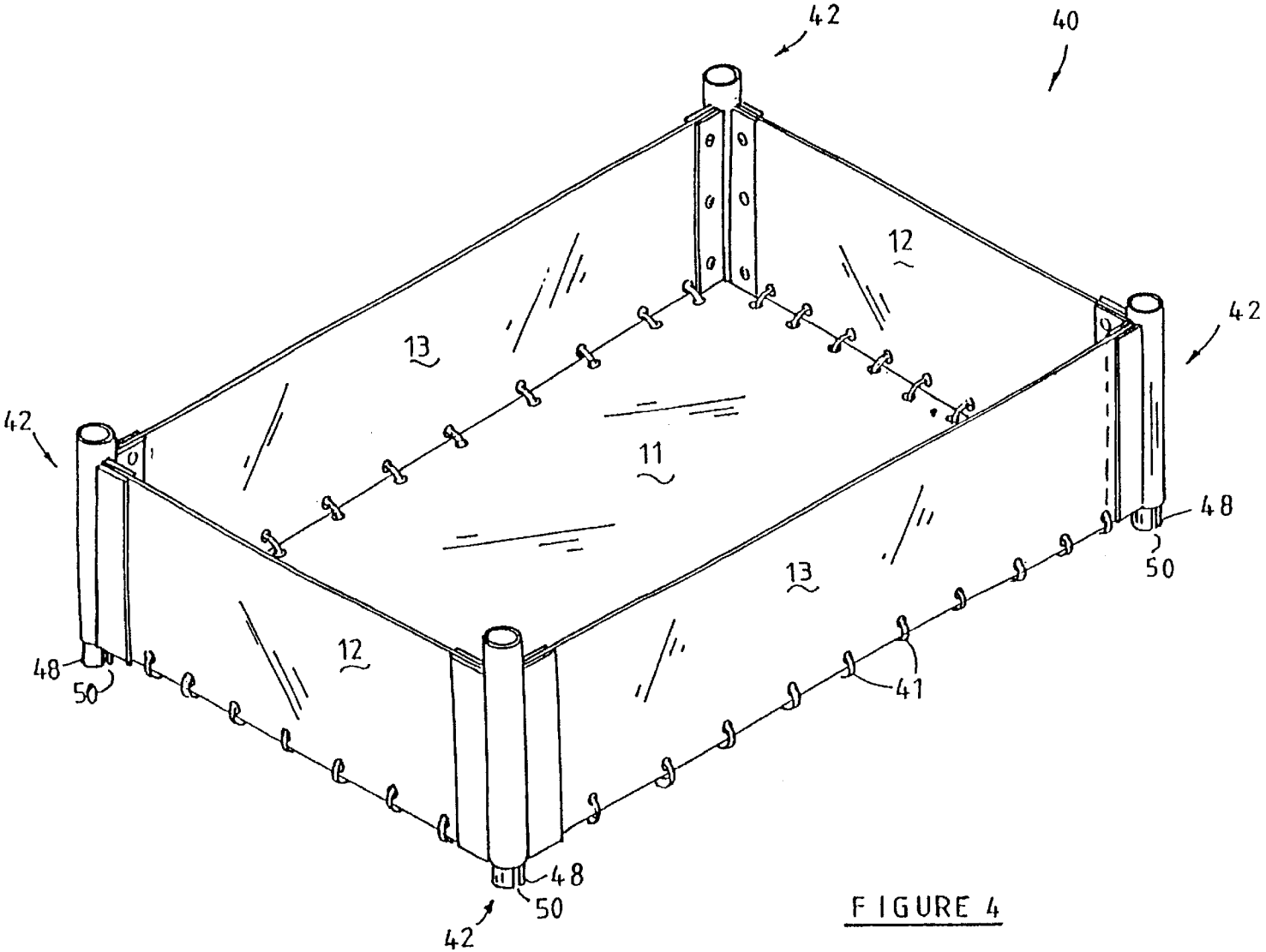
FIG. 4 is a perspective view of a container according to another embodiment of the invention with the container in an erected condition.
Figure 5:
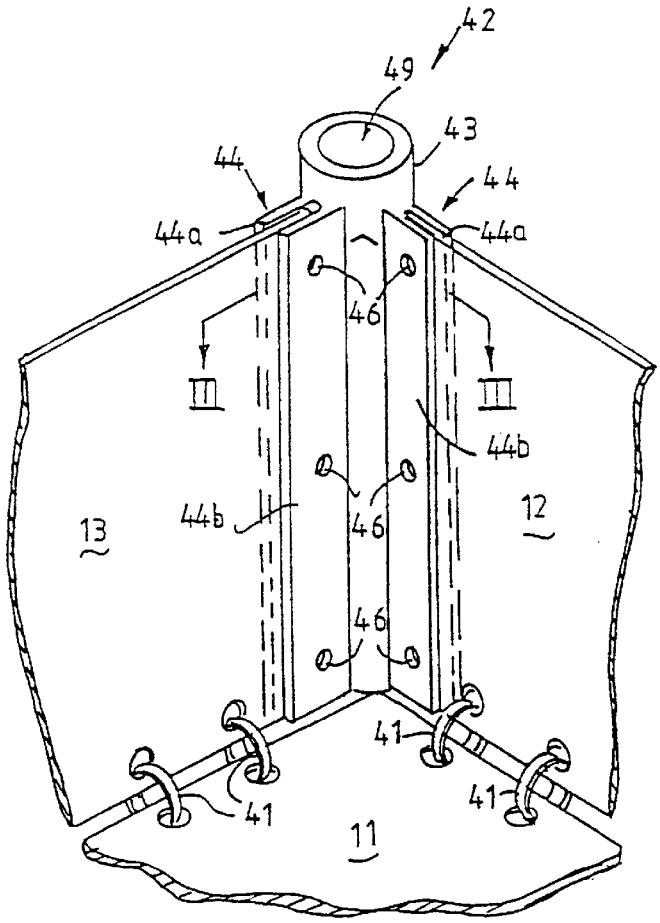
FIGS. 5 and 6 illustrate parts of the container of FIG. 4.
Figure 6:
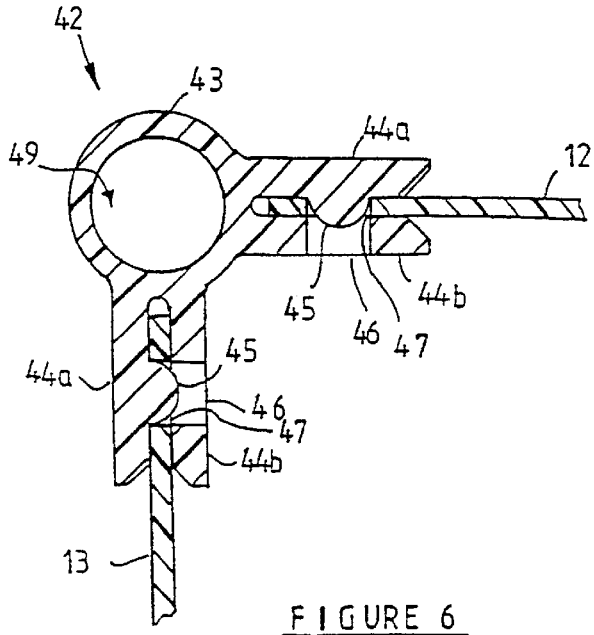
Figure 7:
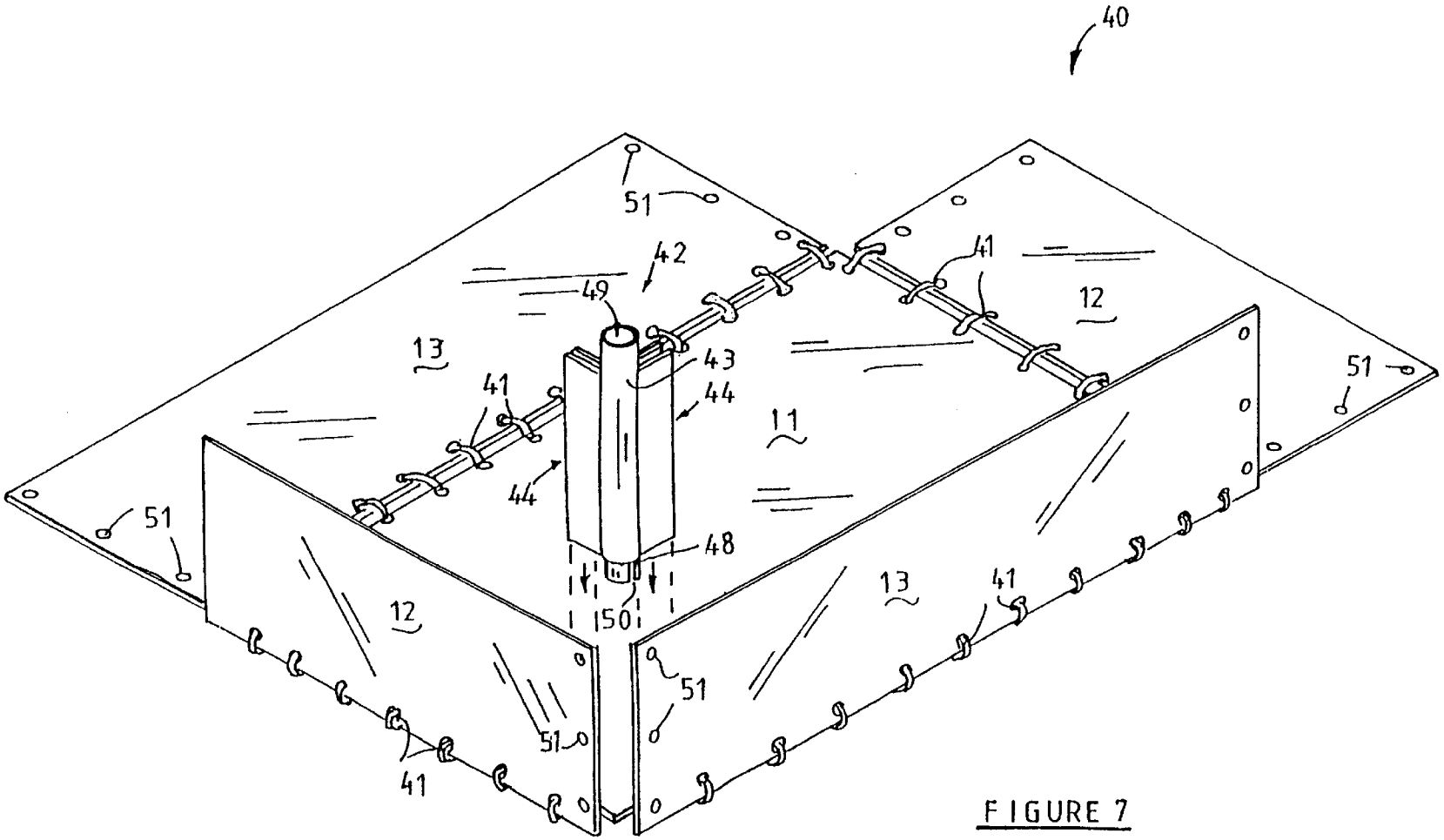
FIGS. 7 to 9 illustrate erection and collapsing of the container of FIG. 4.

Referring first to FIGS. 1 to 3, a container according to the invention is generally designated by reference numeral 10 and comprises a base panel 11, a pair of opposed end wall panels 12 and a pair of opposed side wall panels 13. The base panel 11, end wall panels 12 and side wall panels 13 may be of any suitable material such as polypropylene, high density polyethylene, polycarbonate or even board material such as fluted paper board or fluted polymeric board.

The container 10 optionally may include two connectable roof panels 30*a*, 30*b* wherein one roof panel 30*b* includes a number of slotted apertures for receiving lip formations 31 extending from roof panel 30*a*.

The end wall panels 12 and side wall panels 13 are foldable relative to the base panel 11 with the end wall panels 12 and side wall panels 13 being attached to the base panel by any suitable connection means including ringlets, crease lines, perforations, film hinges or the like.

The container 10 includes a corner post 25 at each corner joining adjacent end wall panels 12 and side wall panels 13 where they adjoin one another in an upright position. Apart from joining the side wall panels 13 with the end wall panels 12, the corner posts 25 also act as weight bearing members. As a result, the base panel 11, end wall panels 12 and side wall panels 13 can be of thin wall sheet material, thus saving materials costs.

In this embodiment of the invention, the corner post 25 comprises a tubular member 16 and three sets of flanges directed at substantially right angles to one another and integrally formed with the tubular member 16. Each set of flanges comprises a pair of parallel flanges 26, 28 between which an end wall panel 12 or a side wall panel 13, as the case may be, is received. Each pair of flanges 26, 28 comprises an outer flange 28 and an inner flange 26.

Each outer flange 28 includes an engaging formation including a rib 29*a* directed at a right angle to the outer flange 28, and an arrowed head 29*b* configured releasably to protrude through slotted aperture 27 provided in the end wall panel 12 or a side wall panel 13 so as to engage the inner flange 26 in a snap fit fashion.

The container 10 of the invention is filly collapsible in that the four corner posts 25 may be removed and the container 10 laid out in a flat condition, whereafter the end wall panels 12 and side wall panels 13 may be folded inwardly relative to the base panel 11 to form an easily transportable unit.

In this embodiment of the invention, each corner post 25 has an integral spigot 21 at its upper end which is receivable in a socket (not shown) formed in the lower end of a corresponding corner post 25 when two containers are stacked on one another.

Reference is now made to FIGS. 4 to 9. In this embodiment of the invention, a container according to the invention is generally designated by reference numeral 40. The container again includes end wall panels 12 and side wall panels 13 which are foldable relative to a base panel 11. In this embodiment of the invention the end wall panels 12 and side wall panels 13 are attached to the base panel 11 by means of ringlets 41 extending through apertures 51 peripherally located in the end wall panels 12, side wall panels 13 and the base panel 11.

The container 40 has a corner post 42 at each corner joining adjacent end wall panels 12 and side wall panels 13 where they adjoin one another in an upright position. Each corner post 42 comprises a tubular member 43 having two sets of parallel flanges 44 directed at right angles to one another and formed integrally with the tubular member 43. Each set of flanges 44 consists of an outer flange 44*a* and an inner flange 44*b*, between which an end wall panel 12 or side wall panel 13, as the case may be, is held.

It is a feature of the invention that the end wall panels 12 and side wall panels 13 are connected to the corner post 42 by way of a snap fit. It is achieved in this embodiment of the invention by the provision of a series of spaced lugs 45 on each outer flange 44*a*, which align with and project into apertures 46 on each inner flange 44*b*. Corresponding apertures 47 are provided along each lateral edge of each of the end wall panels 12 and side wall panels 13.

Thus, when a corner piece 42 is connected to corresponding panels 12, 13, the lugs 45 snap into engagement with the apertures 47 in the end wall panels 12 and side wall panels 13 respectively. This is more clearly illustrated in FIG. 7 where two panels 12, 13 are raised to a vertical position and a corner post 42 is positioned above the resultant corner and snapped into engagement with the panels 12, 13 by downward displacement of the corner post 42.

Figure 8:
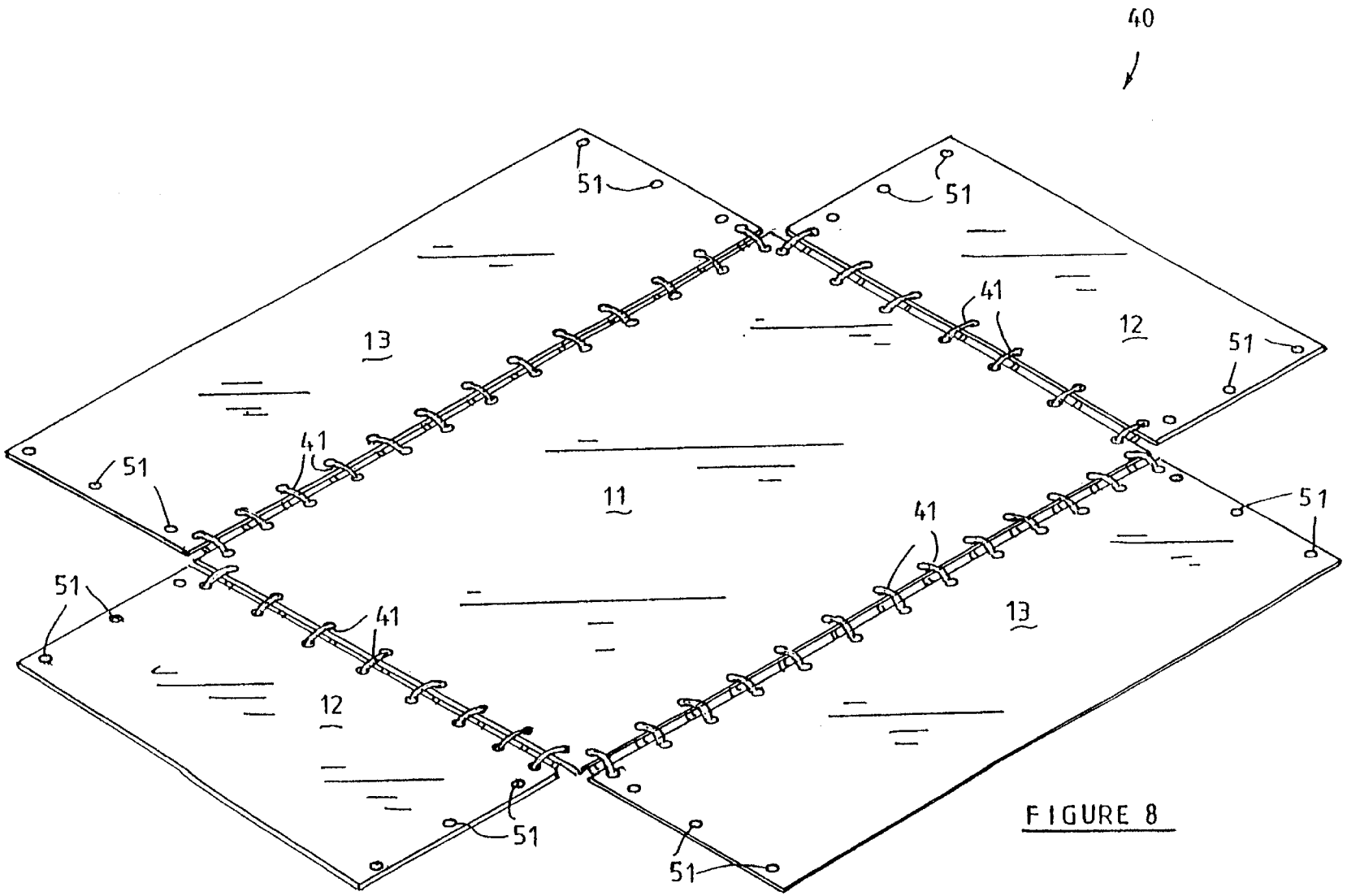
Figure 9:
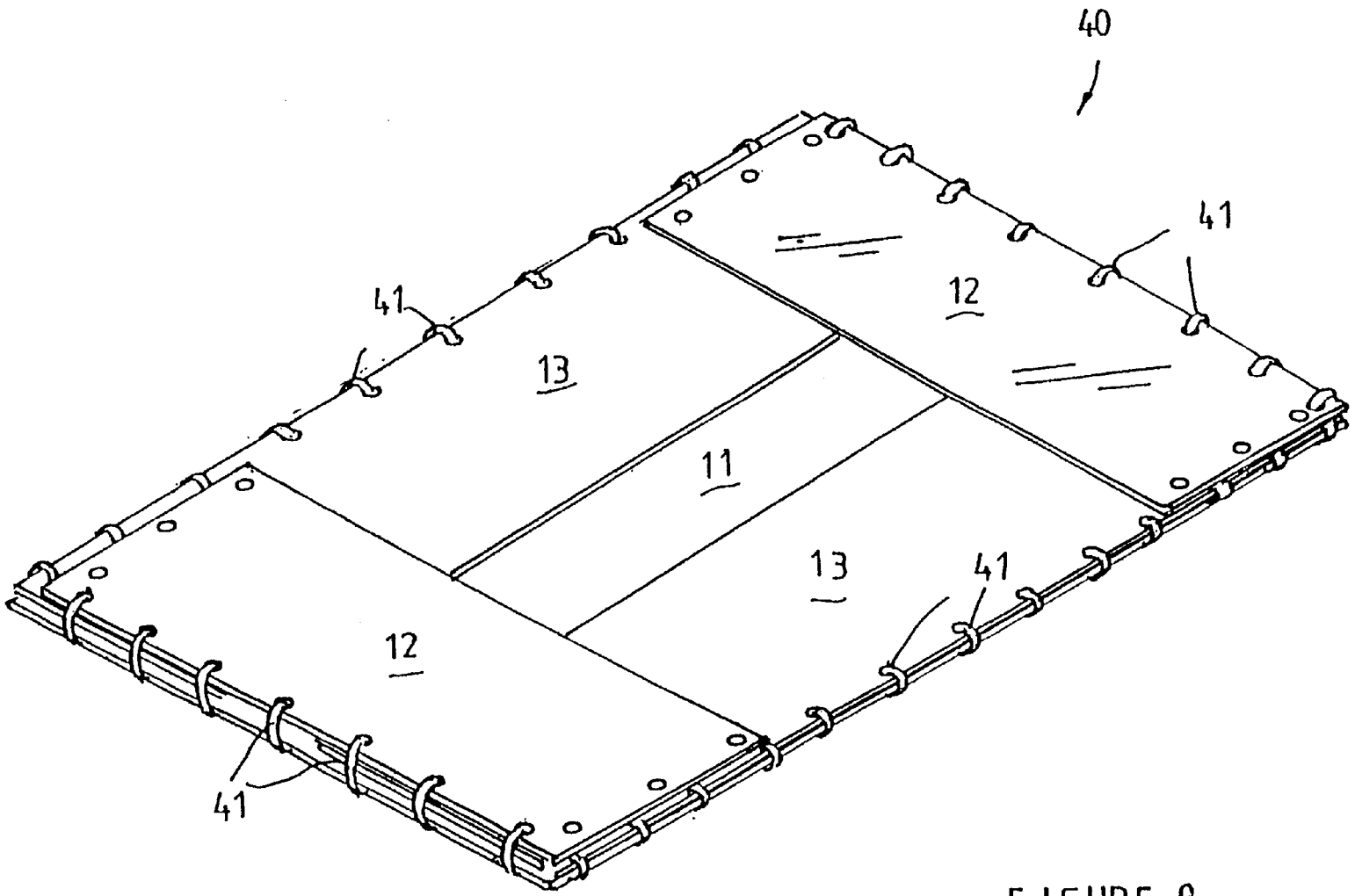
Figure 10:
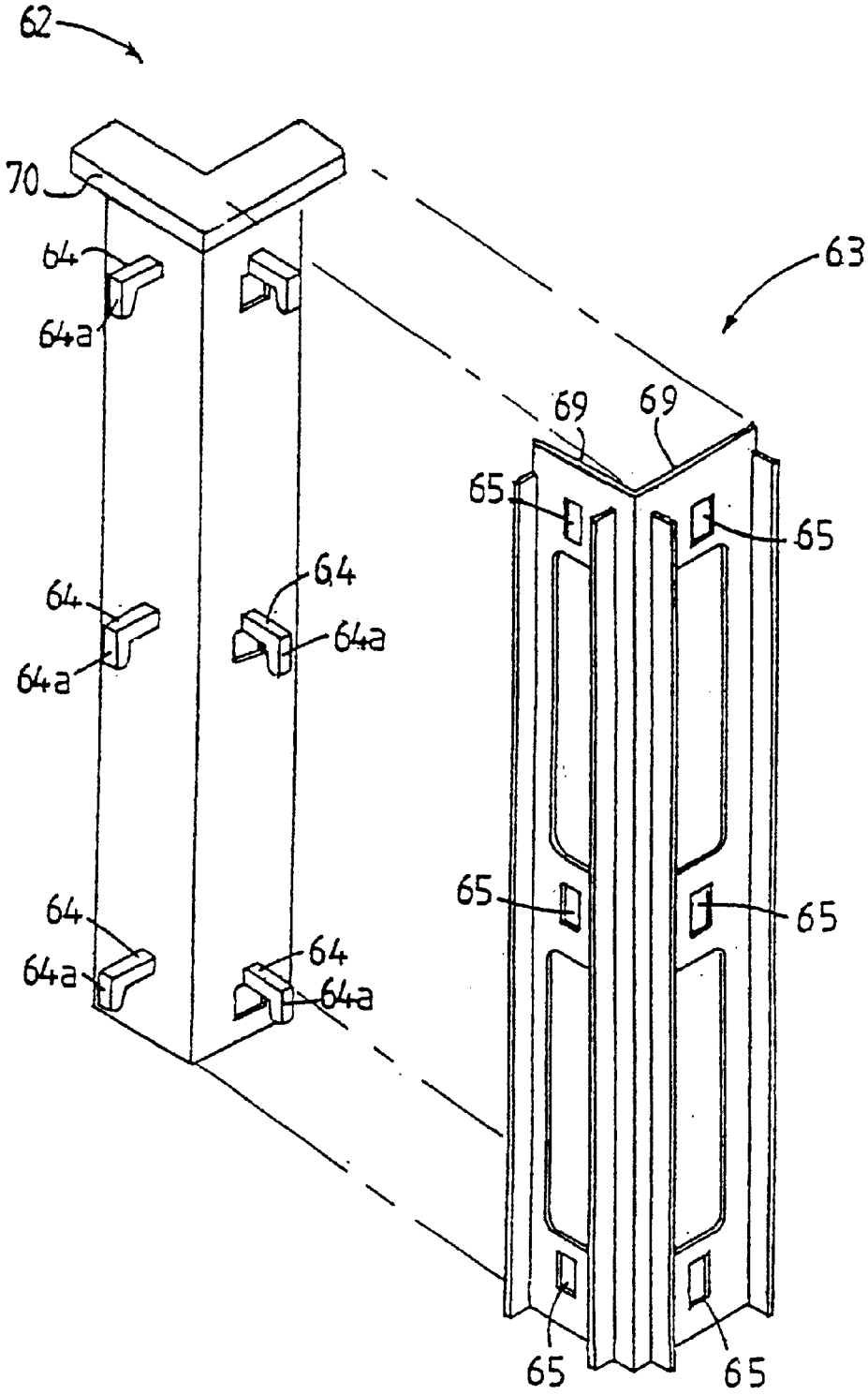
FIG. 10 is a schematic exploded perspective view of a corner post in accordance with yet a further embodiment of the invention in a disassembled form.
Figure 10A:
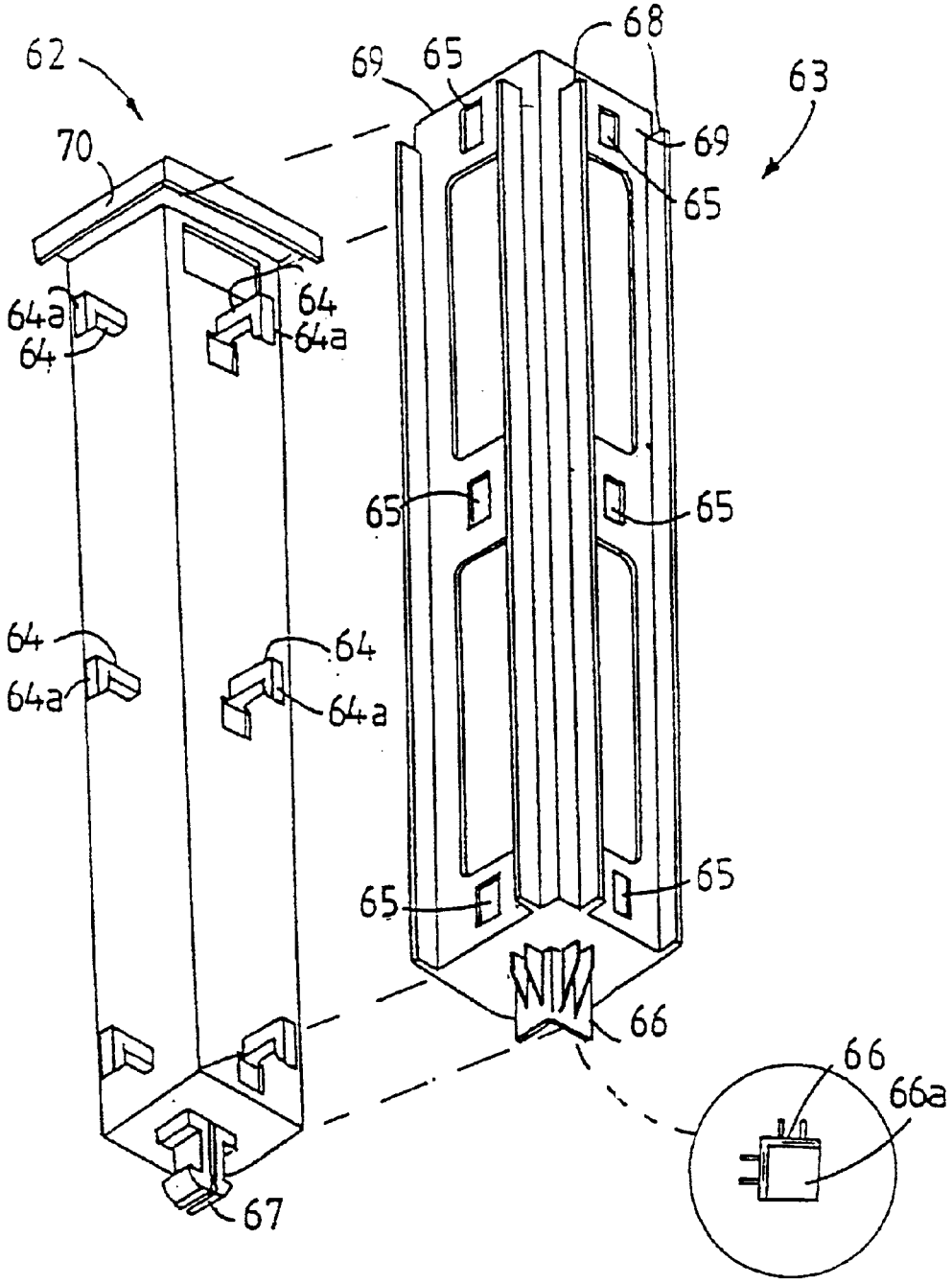
FIG. 10A is a schematic exploded perspective from below of the corner post in FIG. 10.
Figure 11:
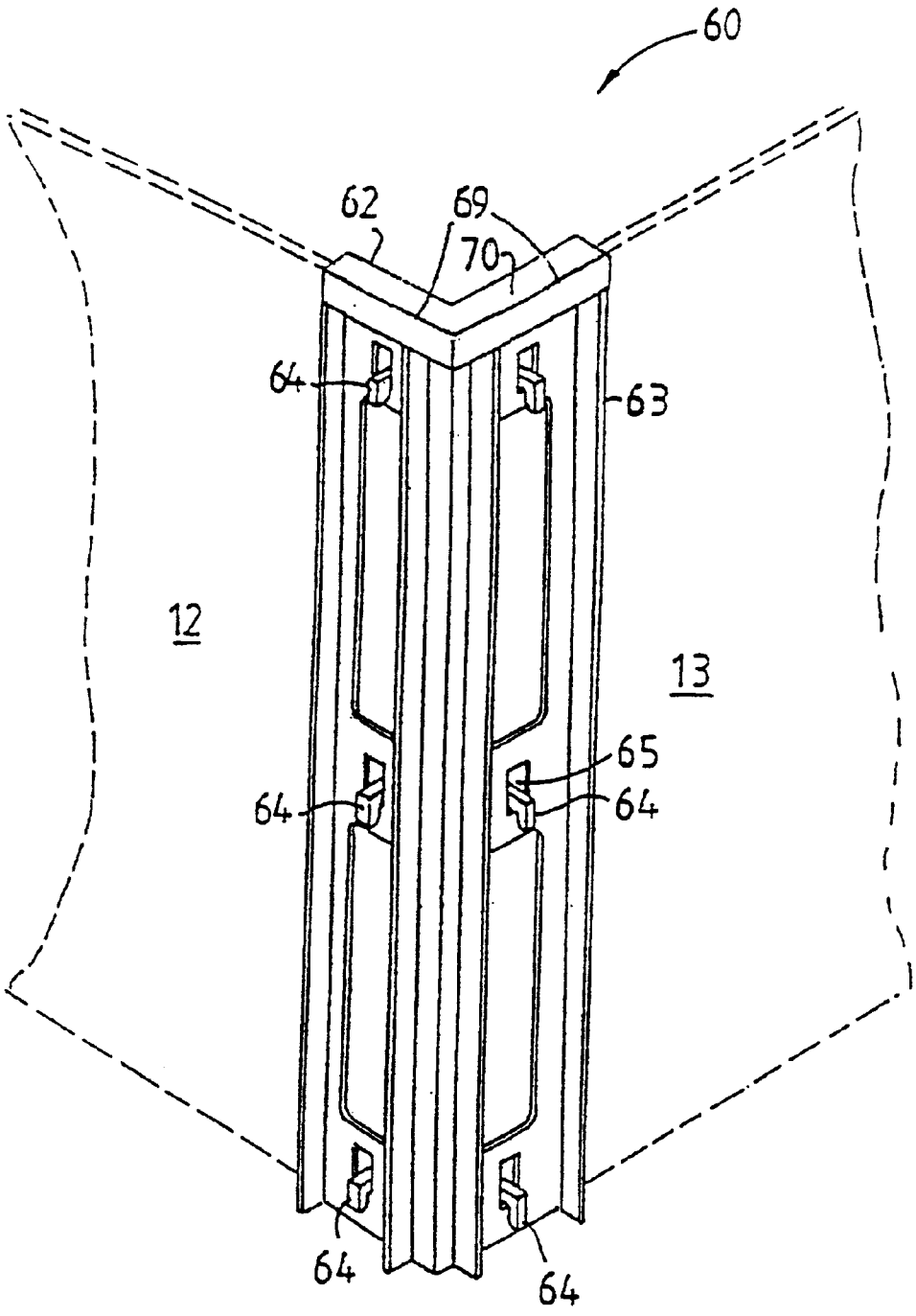
FIG. 11 is a schematic perspective view of the corner post in FIG. 10 in an assembled form.
Figure 12:
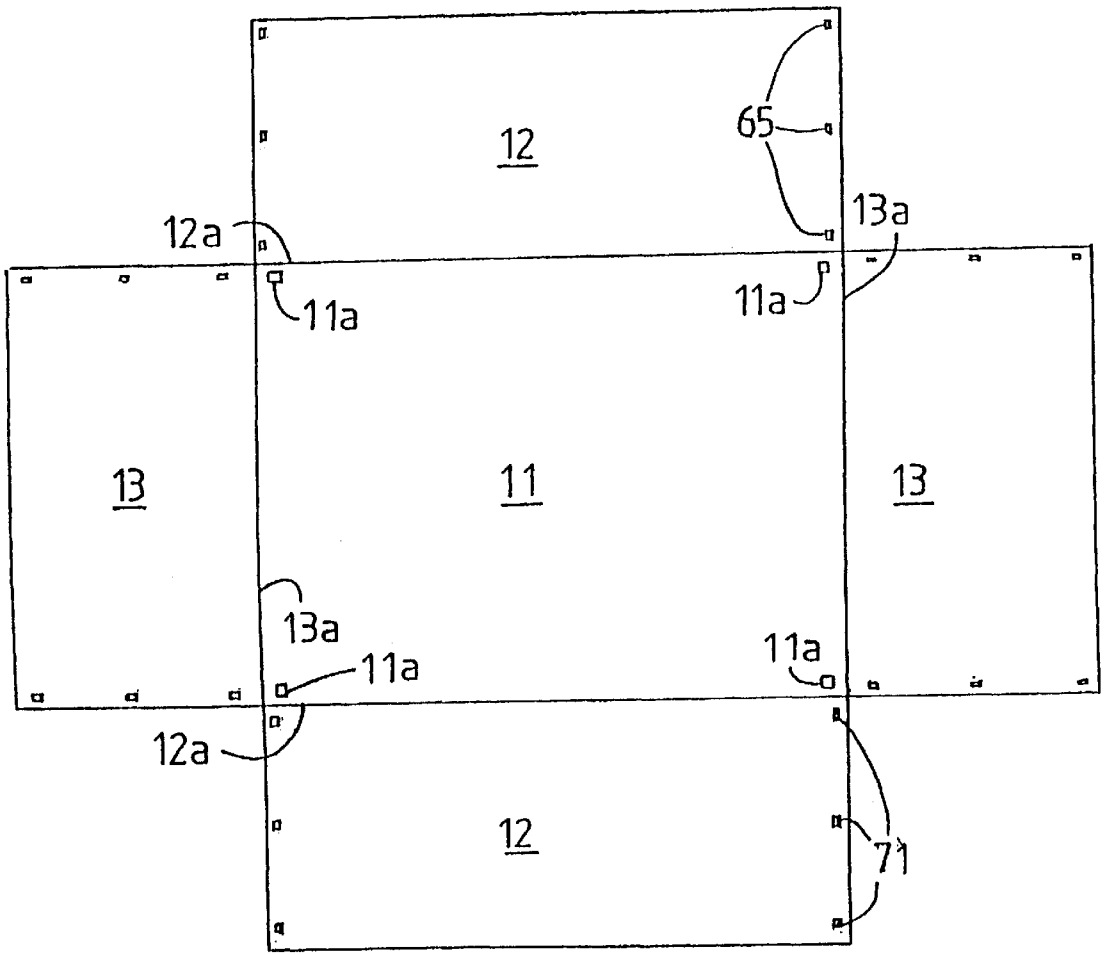
FIG. 12 is a plan view of a blank of a container in accordance with one embodiment of the invention.

The container 40 of this embodiment of the invention is fully collapsible in that the four corner posts 42 may be removed and the container laid out in a flat condition as illustrated in FIG. 8) where after the end wall panels 12 and side wall panels 13 again may be folded inwardly to form an easily transportable unit as shown in FIG. 9.

Each corner post 42 has an integral spigot 48 at its lower end which is receivable in a socket 49 formed in the upper end of a corresponding corner post when two containers of the invention are stacked on one another. Each spigot 48 is slotted as idicated by numeral 50. The slots are designed to fit on to the upper free end of an end wall panel 12 or side wall panel 13), as the case may be, when containers 40 are cross-bonded, that is to say when two containers are located on one another at right angles to their normal, orthogonal stacking position.

Reference is now made to FIGS. 10 to 13, which illustrate yet a further embodiment of the invention. In this embodiment of the invention, there is provided a corner post 60 for a collapsible container 61, wherein the container 61 again comprises a base panel 11, a pair of opposed side wall panels 13 and a pair of opposed end wall panels 12, the side wall panels 13 and end wall panels 13 meeting at corner zones 61*a* of the container 61.

The corner post 60 of the invention comprises an inner post section 62, which is adapted to nest within a corner zone 61*a*, and an outer post section 63 which fits over the outer surface of the corner zone 61*a*, with connecting means being provided to couple the inner post section 62 and the outer post section 63 together with sheet material of the side wall panels 13 and end wall panels 12 at the corner zones 61*a* being sandwiched between these post sections 62, 63.

In the arrangement illustrated, the connecting means comprises a plurality of tongue elements 64 provided on one of the post sections 62, 63, in this case the inner post section 62, and which extend through apertures 71 in the sheet material 12, 13 and engage in slots 65 in the outer post section 63. For engagement purposes, the tongue elements terminate in hook formations 64a which engage behind the slots 65.

Alternatively, the tongue elements 64 could terminate in expanding barbs or other suitable locking means.

The corner post 60 of the invention further provides a foot formation 66 which protrudes below the surface of the base panel 11 of the container 61 to act as a surface engaging means or as a stacking formation which is adapted to nest within a corner of an underlying container. Thus for example, the foot formation 66 could extend from the lower extremity of the outer post section 63. With such an arrangement the inner post section 62 will preferably define a spigot formation 67 which is adapted to mate with a corresponding aperture 66*a* defined adjacent the foot formation 66 to act as a further engagement means between the outer and the inner post sections 62, 63. In the arrangement illustrated, the spigot formation 67 includes an expanding barb arrangement for purposes of locking the spigot formation 67 within the aperture 66*a*.

Both the inner and outer post formations 62, 63 are therefor of generally V-shaped cross-section and will preferably include reinforcing ribs as required, such as that shown at 68.

The inner and outer post section 62, 63 are further coupled together by means of mating tongue and groove formations 69, 70 provided at the upper extremities of the post sections 62, 63. In the arrangement illustrated, a groove formation 70 is defined by the inner post section, and is adapted to receive a corresponding tongue formation 69 defined at the extremity of the outer post section 63.

Figure 13:
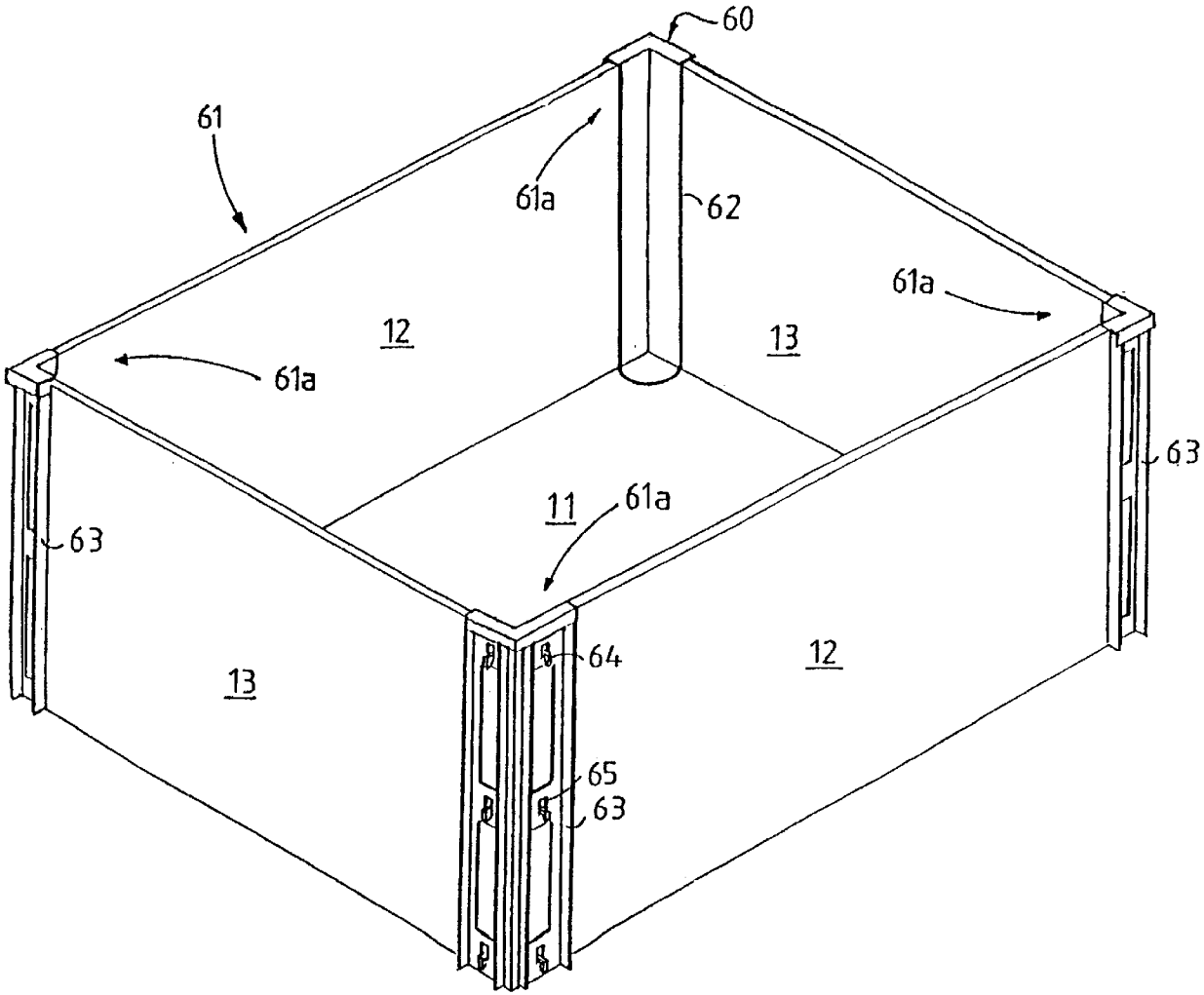
FIG. 13 is a schematic perspective view of a container illustrated in FIG. 12 in an assembled form and including the corner posts of FIG. 10.

As mentioned above, the corner post of the invention is in particular designed for use in erecting and strengthening a collapsible container, and a blank for such a container is shown in FIG. 13. The blank comprises a base panel 11, a pair of opposed side wall panels 13 which are hinged to the base panel 11 along a crease line 12*a*, and two opposed end wall panels 12 also hinged to the base panel 11 along a crease line 13*a*. Thus, in a collapsed configuration, the side wall panels 13 and the end wall panels 12 can be folded into positions overlying the base panel 11 for storage or transport purposes. In its erected configuration, the side wall panels 13 and end wall panels 12 will be folded to extend upwardly at right angles from the base panel 11 so that the ends of these panels meet at four corner zones 61*a*.

Once the panels 12, 13 of the container have been folded as above, the corner post of the invention will be erected in each corner zone 61*a* to lock the container in its erected position. In such an erected position, the tongue elements 64, which lock the corner post sections 15, 16 to one another, will pass through apertures 71 (FIG. 12) in the sheet material of the container. The spigot formation 67 on the inner post section 62 will also pass through an aperture 11*a* in the base panel 11 as spigot formation 67 engages within the aperture 66*a*.

Many other embodiments of the invention are possible without departing from the spirit or scope of the invention defined in the claims. For example, it will be appreciated that many different ways may be used to connect the corner posts of the container to the side wall panels. These may include providing slots in a corner post into which the side wall panels are fitted, flanges with studs on to which the panels are clipped, bulbous formations on the ends of the panels which snap into suitably shaped recesses in the corner posts, and interconnecting formations joined by pins or the like. The invention is directed to a corner post, a collapsible container utilizing the corner post as well as a blank adapted for forming the container of the invention.

What is claimed is:

1. A corner post for a container formed of sheet material, the container including sidewall panels and end wall panels having respective heights, each of the sidewall panels configured to form a junction with a corresponding one of the end wall panels at a corner zone, the sidewall and end wall panels having respective outer surfaces and respective opposite inner surfaces, the sidewall and end wall panels including respective first apertures extending therethrough, the corner post comprising:

a rigid outer post section extending the respective heights of the sidewall and end wall panels and configured to be disposed against the respective outer surfaces of the sidewall and end wall panels at the corner zone;

a rigid inner post section extending the respective heights of the sidewall and end wall panels and configured to be disposed against the respective opposite inner surfaces of the sidewall and end wall panels at the corner zone, the outer and inner post sections being separately formed; and connectors coupling the outer and the inner post sections together to sandwich the sidewall and end wall panels at the corner zone between the outer and inner post sections, the connectors including first engagement formations arranged on one of the outer and inner post sections, the connectors further including respectively positioned second engagement formations arranged on another one of the inner and outer post sections, the first engagement formations being positioned and shaped to extend through the respective first apertures of the sidewall and end wall panels to inter-engage with the respectively positioned second engagement formations when the outer and inner post sections are coupled together.

2. The corner post according to claim 1, wherein the first engagement formations include tongue formations and the second engagement formations include apertures, the tongue formations of the first formations being configured to engage with the apertures of the second formations when the outer and inner post sections are coupled together.

3. The corner post according to claim 2, wherein the tongue formations define lateral hook or barb elements that engage the second formations.

4. The corner post according to claim 1, wherein the first engagement formations of the connectors are configured to inter-engage with the respectively positioned second engagement formations of the connectors via a snap-fit when the outer and inner post sections are coupled together.

5. The corner post according the claim 1, wherein the first engagement formations include integral lugs configured to inter-engage with the respectively positioned second engagement formations when the outer and inner post sections are coupled together.

6. The corner post according to claim 1, further comprising a first stacking element arranged on one end of the corner post and a second stacking element arranged on another end of the corner post, the first stacking element being configured to releasably engage with a second complementary stacking element of another corner post when the corner posts are stacked upon one another.

7. The corner post according to claim 6, wherein the first stacking element includes an integral spigot and the second stacking element includes a socket the integral spigot of the first stacking element being complementary with and configured to engage with a socket of the second stacking element of the other corner post when stacked upon one another.

8. The corner post according to claim 7, wherein the first stacking element includes an extending foot formation arranged on the outer post section, the foot formation being configured to engage with the second stacking element, the second stacking element being arranged on the inner post section.

9. The corner post according to claim 8, wherein the foot formation includes an expanding barb adapted to pass through a base of the container, and the second stacking element includes a socket, the expanding barb being configured to engage with a socket of second stacking element of the other corner post.

10. A collapsible container formed of sheet material, comprising:

a base panel;

opposed sidewall panels connected to the base panel, the sidewall panels having respective heights, opposed end wall panels connected to the base panel, the end wall panels having respective heights, the sidewall panels and the end wall panels being movable to an upright position relative to the base panel, thereby defining corner zones between adjacent sidewall and end wall panels, the sidewall and end wall panels having respective outer surfaces, opposite inner surfaces, and first apertures extending therethrough; and corner posts configured to releasably connect the adjacent sidewall and end wall panels at the corner zones, each corner post including:

a rigid outer post section extending the respective heights of the sidewall and end wall panels and configured to be disposed against the respective outer surfaces of the sidewall and end wall panels at a respective one of the corner zones;

a rigid inner post section extending the respective heights of the sidewall and end wall panels and configured to be disposed against the respective opposite inner surfaces of the sidewall and end wall panels at the respective one of the corner zones, the outer and inner post sections being separately formed; and connectors coupling the outer and the inner post sections together to sandwich the sidewall and end wall panels at the respective one of the corner zones between the outer and inner post sections, the connectors including first engagement formations arranged on one of the outer and inner post sections, the connectors further including respectively positioned second engagement formations arranged on another of the inner and outer post sections, the first engagement formations being positioned and shaped to extend through the respective first apertures of the sidewall and end wall panels to inter-engage with the respectively positioned second engagement formations when the outer and inner post sections are coupled together.

11. The collapsible container according to claim 10, further comprising hinges to connect the sidewall and end wall panels to the base panel.

12. The collapsible container according to claim 10, further comprising at least two connectable roof panels adapted to releasably engage with one another.

13. The collapsible container according to claim 12, wherein a first one of the roof panels includes a plurality of slotted apertures and a second one of the roof panels includes lip formations configured to respectively engage with the slotted apertures of the first roof panel.

14. The collapsible container according to claim 10, wherein the sidewall and end wall panels include apertures in an area of the corner zones, the apertures being adapted to receive the first engagement formations of the connectors therethrough.

* * * * *